US005931549A

United States Patent [19]

Lindberg

[11] Patent Number: 5,931,549

[45] Date of Patent: Aug. 3, 1999

[54] COMPUTER WORKSTATION WITH MOVABLE PLATFORM

[76] Inventor: Paul E. Lindberg, 6477 Park Ridge Dr., Anderson, Calif. 96007

[21] Appl. No.: 08/917,663

[22] Filed: Aug. 25, 1997

[51] Int. Cl.[6] ..... A47B 81/00

[52] U.S. Cl. ..... 312/223.3; 312/26

[58] Field of Search ..... 312/22, 23, 24, 312/26, 27, 30, 194, 195, 208.5, 223.3, 313, 316, 319.2, 327, 21, 208.1, 7.2; 108/38, 13, 34; 248/919, 917, 922, 923

[56] References Cited

U.S. PATENT DOCUMENTS

| | | | |
|---|---|---|---|
| 956,513 | 5/1910 | Bickel | 312/26 |
| 1,285,612 | 11/1918 | Byron | 312/26 |
| 1,398,618 | 11/1921 | Albro | 312/26 X |
| 2,123,687 | 7/1938 | Wells | 312/30 X |
| 2,401,526 | 6/1946 | Ullman | 312/22 |
| 2,499,713 | 3/1950 | Bargen | 312/208.1 X |
| 2,798,782 | 7/1957 | Applegate | 312/26 |
| 4,562,482 | 12/1985 | Brown | 248/917 X |
| 5,364,177 | 11/1994 | Ugalde | 312/208.1 X |

FOREIGN PATENT DOCUMENTS

| | | | |
|---|---|---|---|
| 304921 | 1/1933 | Italy | 312/26 |
| 629788 | 12/1961 | Italy | 312/30 |

*Primary Examiner*—Jose V. Chen
*Assistant Examiner*—Janet M. Wilkens

[57] ABSTRACT

A computer workstation has a rectangular desktop with an opening in it. A locking lid fills the opening when the desk is closed, thus leaving a reasonably solid and smooth desktop. When the locking lid is released, gas springs under pressure push a platform (connection at right angles to the lid) causing both to rotate on a continuous hinge until the platform becomes level with the desktop and the lid is perpendicular to the desktop. Attached to the platform is a computer, which now is in a level position in front of the operator. By applying minimal downward pressure, the computer, platform, and lid return to the closed position. A keyboard tray, located in the center of the workstation and below the front edge of the desktop, can be used in the retracted position for learning touch-typing or extended for typing with the keyboard visible. A lockable door in the front of the workstation covers the inner area where the computer hangs on the platform when in the closed position.

1 Claim, 5 Drawing Sheets

COMPUTER WORKSTATION WITH MOVABLE PLATFORM

BACKGROUND-FIELD OF INVENTION

The invention relates to computer workstations, and more specifically to computer desks with multiple uses.

BACKGROUND-DESCRIPTION OF PRIOR ART

With the advent of computers in large numbers both in businesses and at schools, desktop space has become encumbered. Currently the most popular solution has been a "hidden-monitor" desks such as the desk U.S. Pat. No. 5,364,177. These have been introduced to solve this dilemma however they have their own inherent problems. No storage or minimal storage is available. Heat Builds up around the computer since it is surrounded by the desk and although cooling slots or holes are provided excess heat is still present. Glare from the glass insert on the desktop makes viewing the computer difficult. To alleviate the glare, U.S. Pat. No. 5,368,377 replaced the glass with a flip top door, however this does not address the heating problem and similarly to the "hidden monitor" desk, the operator has to look downward inside the desk to see the monitor. This leads to neck and back fatigue and for small children, great difficulty seeing the screen at all.

OBJECTS AND ADVANTAGES

Several objects and advantages of the present invention are:

(a) to provide operator comfort when viewing the computer;
(b) to provide a clear desktop when the computer is not in use;
(c) to provide a keyboard tray positioned to allow for touch-type training as well as conventional typing;
(d) to provide open air cooling for the computer when in use;
(e) to provide security for the computer when not in use;
(f) to provide an area in front of the computer to place papers and books when working. Further objects and advantages will become apparent from a consideration of the ensuing description and drawings.

DRAWING FIGURES

Reference Numerals In Drawings

Figure 1:
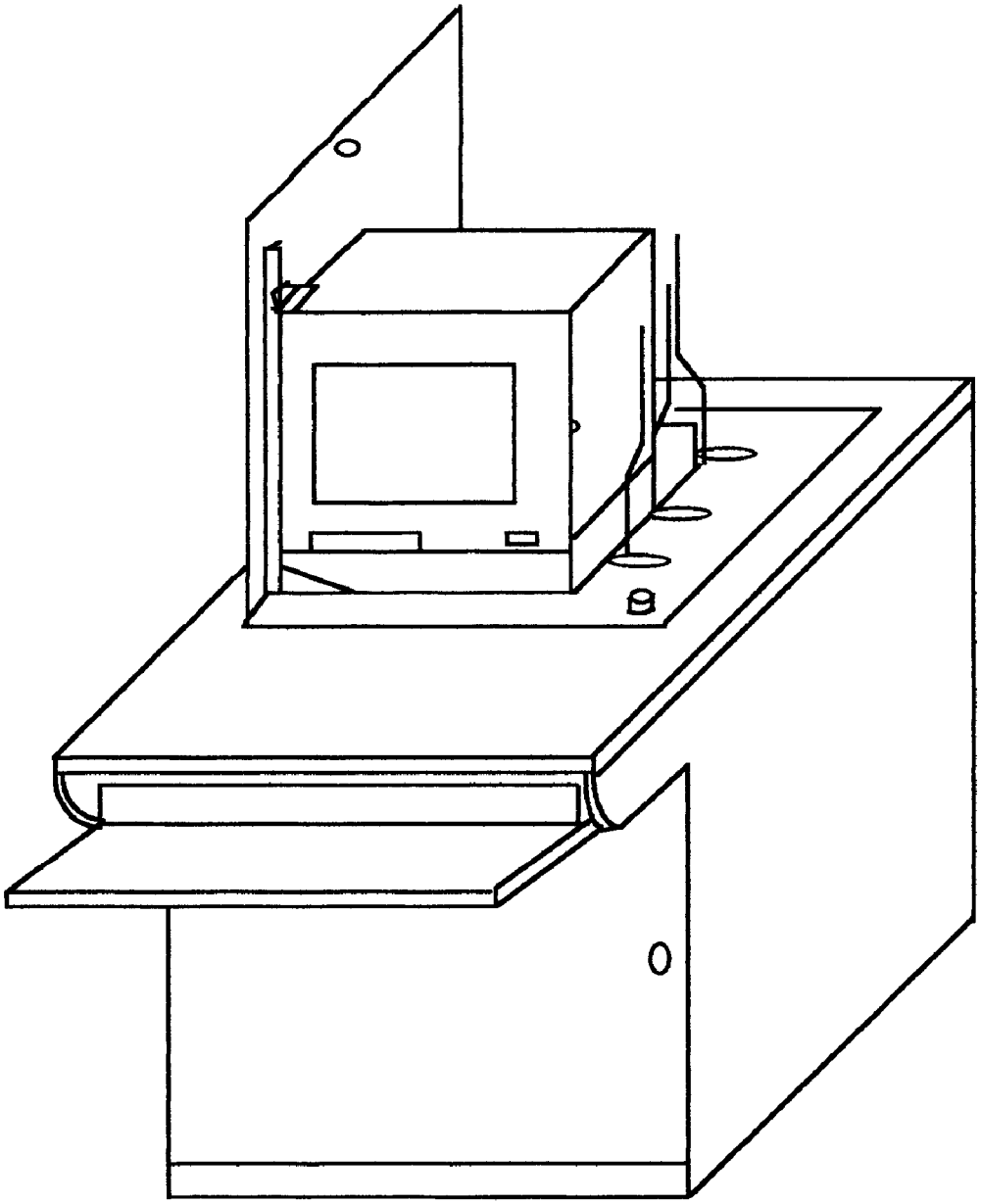
FIG. 1 is a perspective view of the workstation in an open position with the keyboard tray extended.
Figure 2:
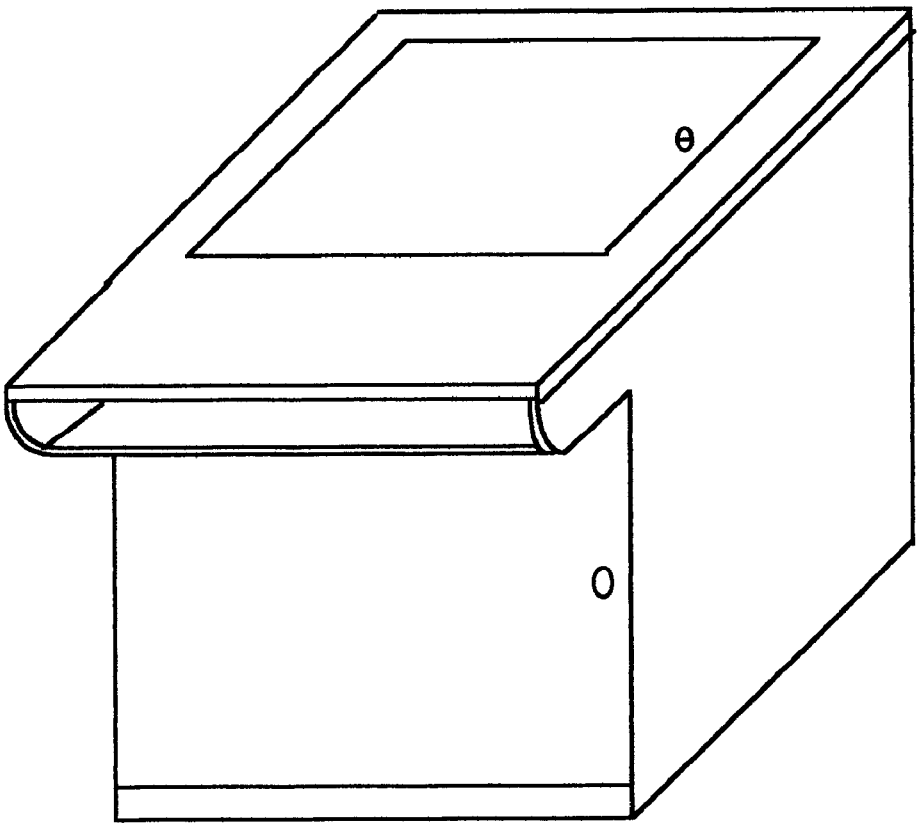
FIG. 2 is a perspective view of the workstation in a closed position with the keyboard tray retracted.

12. Port, back panel
14. Door
15. Bottom
16. Lock, door

17T. Front rail, top
17B. Front rail, bottom
18R. Vertical side panel, right
18L. Vertical side panel, left
19. Back
20R. Upper ball bracket, rear
20F. Upper ball bracket, front
21. Platform
22. Lock, platform
26F. Rod, "s" nut, washer, and slot, front
26M. Rod, "s" nut, washer, and slot, middle
26R. Rod, "s" nut, washer, and slot, rear
27. Rectangular top
28. Port, platform
30. Bracket, rear
32. Lid
34. Lock, lid
36. Bracket, front
38. Bracket, angle
39. Bolt, bracket, nut, washers
41 F. Adjustable lower ball bracket, front
41 R. Adjustable lower ball bracket, rear
42F. Gas spring, front
42R. Gas spring, rear
44. Keyboard tray
45L. Keyboard slide, left
45R. Keyboard slide, Right
46. Bracket, continuous hinge
48. Spring, compression

DETAILED DESCRIPTION

DETAILD DESCRIPTION OF THE PREFERRED EMBODIMENTS

Figure 3:
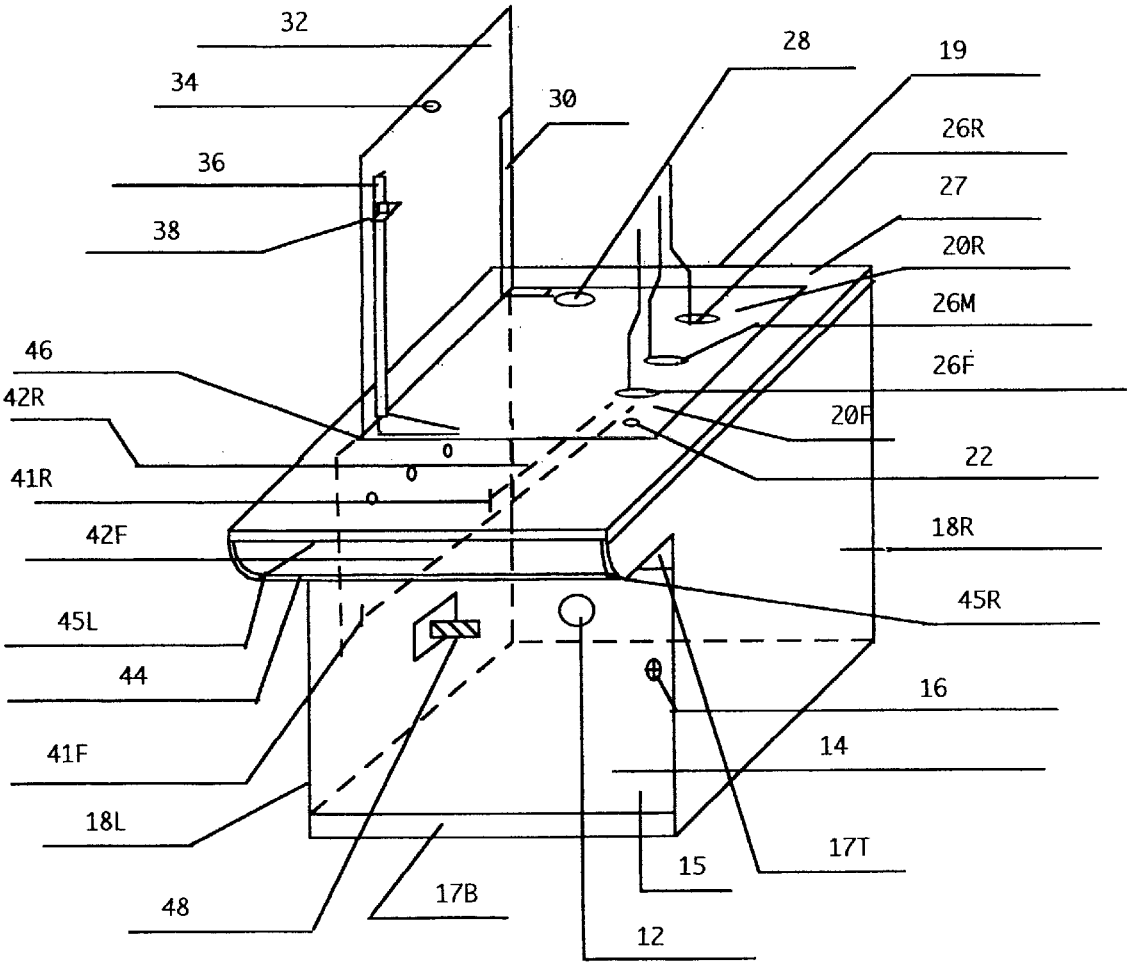
FIG. 3 is similar to FIG. 1 but with the computer removed for clarity and having hidden lines revealing the internal mechanism of the workstation.
Figure 4:
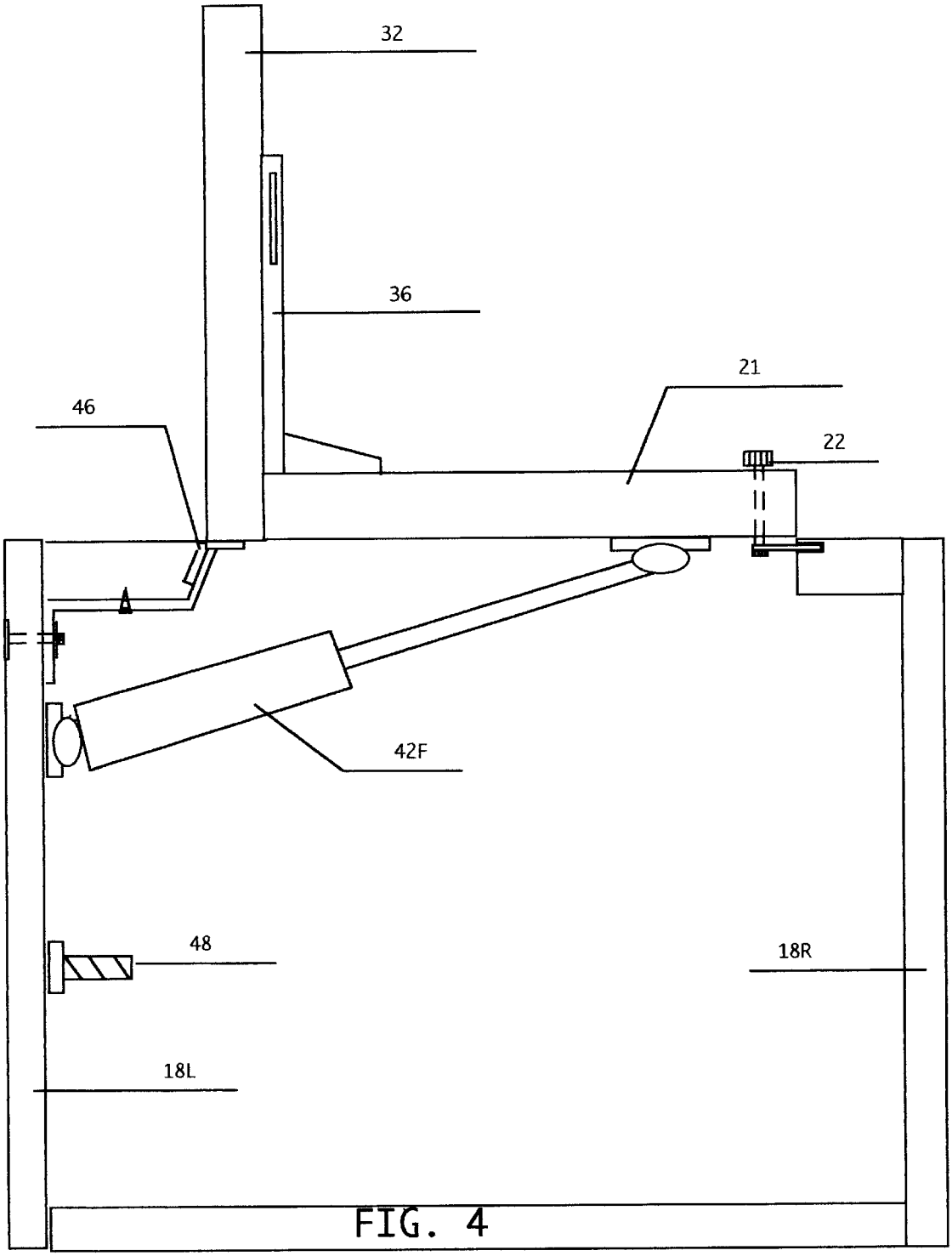
FIG. 4 is an enlarged detail showing a continuous hinge and bracket assembly 46 in FIG. 3 including lower and upper gas spring ball brackets, gas spring, and compression spring.
Figure 5:
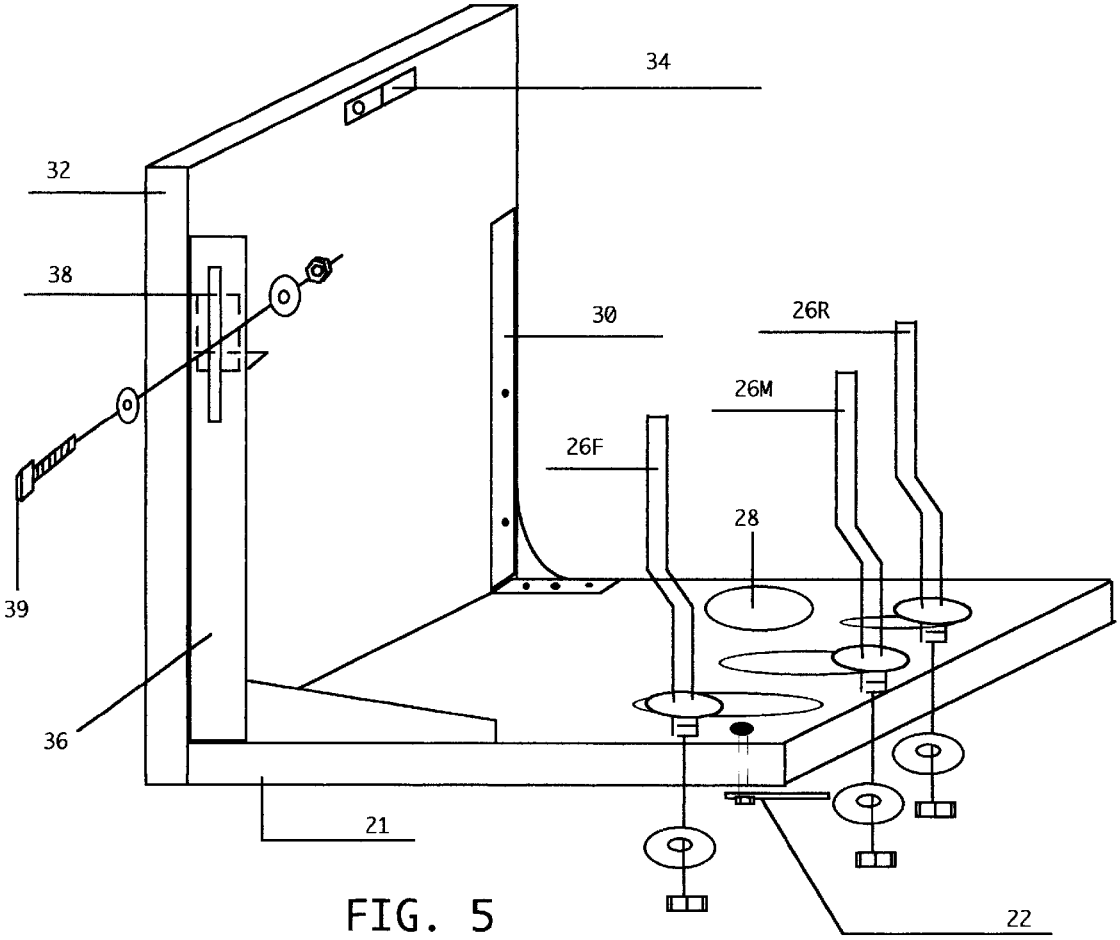
FIG. 5 is an enlarged detail showing the lid (32) and platform (21) assembly including: 22, 26F, 26M, 26R, 28, 30, 34, 36, 38, 39.

Referring to FIG. 3, A computer workstation in accordance with the present invention comprises two opposite vertical side panels (18R) and (18L) connected to the bottom (15), back (19) and front rails (17T) and (17B) by screws.

A top (27) with a laminated plastic work surface is attached to the side panels, back, and front rail by wooden dowels and screws from the steel hinge bracket (46). A platform (21) is connected to a lid (32) by means of a front bracket (36) and a rear bracket (30) by means of screws. Attached by a bolt though a slot in front bracket (36) is an angle bracket (38) used to stop vertical movement when the platform rotates to a closed position. Also included in the platform are three slots with s shaped steel rods (26F), (26M), and (26R). The bottom 2' of the rods are threaded and a washer is welded to each rod at the uppermost end of these threads. Each rod is inserted through it's corresponding slot and a washer and nut are installed from the underside of the platform. The rods are rotated and adjusted laterally in their slots to fit the shape of the installed computer. Tightening of the nuts holds the rods firmly in position allowing the computer, platform (21) and lid (32) to rotate safely. Two locks, (22) and (34) engage in a slot in side panel (18R) to keep the lid (32) and platform (21) assembly (21,32,36,30, 38,26F,26M,26R,20F,20R,34) latched in an open or closed position respectively.

Two ports, (28) in the platform and (12) in the back panel (19) allow routing of cables from a computer though the storage area inside the workstation and out the back to outside connections. A hinge assembly (46) made up of a bracket with a nickel plate piano hinge spot welded to it connects the lid (32)and platform (21) assembly to the vertical side panel (18L).

Attachment is made with three 5/16" "elevator" bolts with locknuts through the side panel (18L) bracket assembly (46) and nine screws through a hinge, and into the platform underside.

Two gas springs, (42R) and (42F) serving as linkage members are connected by means of adjustable lower ball brackets (41R) and (41F) and by upper ball brackets (20R) and (20F) to the vertical side panel (18L) and underside of platform (21) respectively, by means of multiple screws. These gas springs support the weight of the computer, platform (21) and lid (32) assembly and make transition possible with little operator effort. A compression spring (48) attached to the side panel (18L) by means of a wooden block is compressed as the platform (21) and lid (32) assembly rotate towards the closed position, aiding the gas springs, (42R) and (42L) which lose efficiency as the angle between the platform and the gas springs (42R) and (42L) increases. A small amount of pressure on the lid (32) is necessary to fully compress the lid (32) to a lockable position. This pressure causes the lid (32) to pop-up slightly when lock (34) is released. By grasping the now partially open lid (32), the operator can pull upwards slightly and begin the transition to a fully open position. A door (14) covers the area inside the workstation which keeps the mechanism from sight and combined with a lock (16) provides security for storage and the computer when in the closed position. A movable keyboard tray (44) is supported by side mounted drawer slides (45L) and (45R). The keyboard tray is mounted approximately 6" down from the underside of the rectangular top (27) allowing touch-typing to be practiced in the retracted position or typing with the key board visible in the extended position.

SUMMARY OF THE INVENTION

The invention provides a computer workstation in the form of a desk. The top surface has an opening in it with a lid filling the opening in the closed position, making a flat work surface. The lid is connected at a right angle to a platform on which a computer may be attached. This attachment is accomplished by means of three "s" shaped rods which conform to the profile of a computer to stop it from moving on a horizontal plane. In addition, an angle bracket attached to the front bracket, stops movement on a vertical plane. Rotation about a continuous hinge and bracket assembly mounted to the side panel of the workstation and aided by gas springs makes this possible. It is one object of the present invention to have the computer upright and level at the desktop height when in the open position. This allows for comfortable viewing of the monitor in addition, cooling of the computer is not restricted. It is another object of the present invention to provide a sliding keyboard tray which can be used in the retracted position for touch-typing training or extended for typing with the keyboard visible.

I claim:

1. A computer workstation comprising:

a rectangular desk with two vertical side panels, adjoining a back, bottom, and front rails;

a rectangular desktop with an opening therein attached to the desk;

a lid combined at a right angle with a platform, forming an assembly, disposed in the desktop opening and combined with the desktop to yield a substantially flat work surface when in a closed position;

means for movably mounting said lid and platform assembly allow rotation of the assembly resulting in the lid ending at a right angle to said desktop and said platform disposed in said opening in an open position;

a plurality of curved rods attached through the platform and lid assembly, when the assembly is in its open position, said rods being adjustable in a horizontal plane and rotational to conform to various shaped computers, said rods adapted to stop lateral movement of the computer during rotation of said platform and lid assembly;

linkage means attached to the inside of one of the side panels of the desk and connected to the underside of the platform provide movement and suspension for the assembly between its open and closed positions;

a bracket located on the assembly and including means of adjustment confining movement of the computer, when the assembly is in its open position, said adjustment means being vertically adjustable to confine movement of the computer in a vertical plane; and a keyboard tray mounted in the desk below the desktop with space allowing typing with said tray in a retracted position for touch-typing training, or extended for regular typing use.

* * * * *